US007711502B2

(12) United States Patent
Koyama et al.

(10) Patent No.: US 7,711,502 B2
(45) Date of Patent: May 4, 2010

(54) POWER SWITCHING CONTROL APPARATUS

(75) Inventors: Haruhiko Koyama, Tokyo (JP); Tomohito Mori, Tokyo (JP); Kenji Kamei, Tokyo (JP); Sadayuki Kinoshita, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 705 days.

(21) Appl. No.: 11/605,220

(22) Filed: Nov. 29, 2006

(65) Prior Publication Data

US 2007/0285850 A1 Dec. 13, 2007

(30) Foreign Application Priority Data

Jun. 12, 2006 (JP) ..... 2006-162335

(51) Int. Cl.
*H02H 3/00* (2006.01)

(52) U.S. Cl. ..... 702/60; 361/160; 361/170; 361/152; 361/153; 361/154; 361/155; 361/156; 361/2; 323/210; 323/211; 323/209; 323/218; 307/137; 307/135

(58) Field of Classification Search ..... 702/60; 361/83, 8, 9, 13, 160, 170, 152–156; 323/205, 323/207, 210, 211, 209, 208, 215, 218; 307/137, 307/135, 136

See application file for complete search history.

(56) References Cited

U.S. PATENT DOCUMENTS 4,021,678 A * 5/1977 Moakler et al. ..... 307/64
5,874,900 A * 2/1999 Panto ..... 340/644
5,969,496 A * 10/1999 Yamada et al. ..... 318/715
6,172,863 B1 1/2001 Ito et al.
6,291,911 B1 9/2001 Dunk et al.
6,392,390 B1 * 5/2002 Ito et al. ..... 323/209
6,433,980 B1 8/2002 Tsutada et al.
6,493,203 B1 12/2002 Ito et al.
6,538,347 B1 * 3/2003 Baranowski et al. ..... 307/137

(Continued)

FOREIGN PATENT DOCUMENTS

CN 1258086 A 6/2000

(Continued)

OTHER PUBLICATIONS

United Kingdom Search Report dated Apr. 25, 2007.

*Primary Examiner*—Carol S Tsai
(74) *Attorney, Agent, or Firm*—Buchanan Ingersoll & Rooney PC

(57) ABSTRACT

A power switching control apparatus for acquiring pieces of making operation time information of individual phase switches more precisely according to loads and making instants. Making operation time information detecting means outputs the making operation time information of at least one of individual phase switches on the basis of the motion of the movable contact of the phase switch, and outputs the making operation time information of at least another of the individual phase switches on the basis of the phase current of the phase switch. Moreover, the making operation time information detecting means outputs the making operation time information ITA, ITB and ITC of an A-phase switch, a B-phase switch and a C-phase switch individually on the basis of either the detected output of a contact operation sensor and the detected output of a phase current sensor.

7 Claims, 5 Drawing Sheets

U.S. PATENT DOCUMENTS

| | | | | |
|---|---|---|---|---|
| 6,921,989 | B2 * | 7/2005 | Baranowski et al. | 307/139 |
| 7,259,947 | B2 | 8/2007 | Kinoshita et al. | |
| 7,508,645 | B2 * | 3/2009 | Trivette et al. | 361/139 |
| 2003/0071522 | A1 * | 4/2003 | Baranowski et al. | 307/116 |
| 2006/0007623 | A1 * | 1/2006 | Trivette et al. | 361/115 |
| 2008/0143305 | A1 * | 6/2008 | Drugge et al. | 323/209 |

FOREIGN PATENT DOCUMENTS

| | | | |
|---|---|---|---|
| EP | 0 974 993 | | 7/2000 |
| JP | 2001-135205 | A | 5/2001 |
| WO | 00/04564 | A1 | 1/2000 |

* cited by examiner

POWER SWITCHING CONTROL APPARATUS

BACKGROUND OF THE INVENTION

1. Field of the Invention

This invention relates to a power switching control apparatus, which is constituted to arrange phase switches at individual phases of a three-phase AC power circuit and to control the individual phase switches independently of one another.

2. Description of Related Art

A synchronous switching apparatus is disclosed in International Laid-Open WO000/04564. In this synchronous switching apparatus, phase switches arranged at the individual phases of a three-phase AC power circuit are controlled independently of one another, and the individual phase switches are so made at the set phases as to suppress the generation of the inrush current or surge voltage which is severe against the system device such as the transformer, shunt reactor, power lines or capacitor banks of the three-phase AC power circuit.

Generally speaking, however, the contacts of the phase switch are erroded by the arcs, and the drive mechanism of the moving contacts disperses and has its driving characteristics varied according to the surrounding environment such as the ambient temperature. JP2001-135205A has disclosed a one-phase power switching apparatus. In this power switching apparatus, on the basis of the waveform of a phase current and the pre-arcing time of a switch, the making operation time of the switch is detected and is reflected on the control of the next making instant of the switch. This making operation time of the switch is the action time from the time when the making command of the switch is fed to the time when the contact is actually connected.

In case the individual phase switches of the three-phase AC power circuit are made independently of one another and in set phases, no phase current flows in the state where the first phase switch is made, if the load is of a non-grounded neutral point type. In case the load is of the type, in which it has a common core of the grounded neutral point type, the phase switch to be finally made has two preceding phases made so that it is made in the substantial "0" voltage between contact. In the constitution where the making operation time of the phase switch is detected on the basis of the phase current waveform containing pre-arcs, therefore, the phase current waveforms containing the pre-arcs cannot be obtained when all the phase switches are made to raise a problem that it is impossible to detect the making operation times of all the phase switches precisely.

SUMMARY OF THE INVENTION

This invention contemplates to provide a power switching control apparatus, which is improved to solve that problem.

According to a first aspect of the invention, there is provided a power switching control apparatus having an A-phase switch, a B-phase switch and a C-phase switch connected with the A-phase, B-phase and C-phase of a three-phase AC power circuit, respectively, for controlling the individual phase switches independently of one another. The power switching control apparatus comprises making operation time information detecting means for outputting making operation time information ITA, ITB and ITC representing the in individual making operation times of said A-phase switch, said B-phase switch and said C-phase switch, respectively, and switching control means for controlling the making instants of said A-phase switch, said B-phase switch and said C-phase switch on the basis of said making operation time information ITA, ITB and ITC. Said making operation time information detecting means outputs the making operation time information of at least one of said individual phase switches on the basis of the motion of the movable contact of said phase switch, and outputs the making operation time information of at least another one of said individual phase switches on the basis of the phase current of said phase switch.

According to a second aspect of this invention, there is provided a power switching control apparatus having an A-phase switch, a B-phase switch and a C-phase switch connected with the A-phase, B-phase and C-phase of a three-phase AC power circuit, respectively, for controlling the individual phase switches independently of one another. The power switching control apparatus comprises making operation time information detecting means for outputting making operation time information ITA, ITB and ITC representing the individual making operation times of said A-phase switch, said B-phase switch and said C-phase switch, respectively, and switching control means for controlling the making instants of said A-phase switch, said B-phase switch and said C-phase switch on the basis of said making operation time information ITA, ITB and ITC. Three contact operation sensors for detecting the motions of the individual movable contacts of said A-phase switch, said B-phase switch and said C-phase switch, and three phase current sensors for detecting the individual phase currents of said A-phase, said B-phase and said C-phase are connected with said making operation time information detecting means. Said making operation time information detecting means outputs the making operation time information ITA, ITB and ITC of said A-phase switch, said B-phase switch and said C-phase switch individually on the basis of one of the detected output of said contact operation sensor and the detected output of said phase current sensor.

In the power switching control apparatus according to the first aspect of the invention, the making operation time information detecting means outputs the making operation time information of at least one of the individual phase switches on the basis of the motion of the movable contact of the phase switch, and outputs the making operation time information of at least another of the individual phase switches on the basis of the phase current of the phase switch. In the phase where the making operation time information is outputted on the basis of the motion of the movable contact of the phase switch, the making operation time information is obtained on the basis of the motion of the movable contact even if the making operation time information based on the phase current is not obtained. As a result, the making operation time information of the phase switches can be obtained more precisely.

In the power switching control apparatus according to the second aspect of the invention, three contact operation sensors for detecting the motions of the individual movable contacts of the A-phase switch, the B-phase switch and the C-phase switch, and three phase current sensors for detecting the individual phase currents of the A-phase, the B-phase and the C-phase are connected with the making operation time information detecting means. The making operation time information detecting means outputs the making operation time information ITA, ITB and ITC of the A-phase switch, the B-phase switch and the C-phase switch individually on the basis of one of the detected output of the contact operation sensor and the detected output of the phase current sensor. Even if the making operation time information based on the phase current is not obtained on each of the A-phase switch, the B-phase switch and the C-phase switch, the making operation time information can be obtained on the basis of the motions of the movable contact. As a result, the making operation time information of the phase switches can be obtained more precisely.

The foregoing and other objects, features, aspects, and advantages of the present invention will become more apparent from the following detailed description of the present of invention when taken in conjunction with the accompanying drawings.

DESCRIPTION OF THE PREFERRED EMBODIMENTS

Several embodiments of the present invention are described in the following with reference to the accompanying drawings.

Embodiment 1

Figure 1:
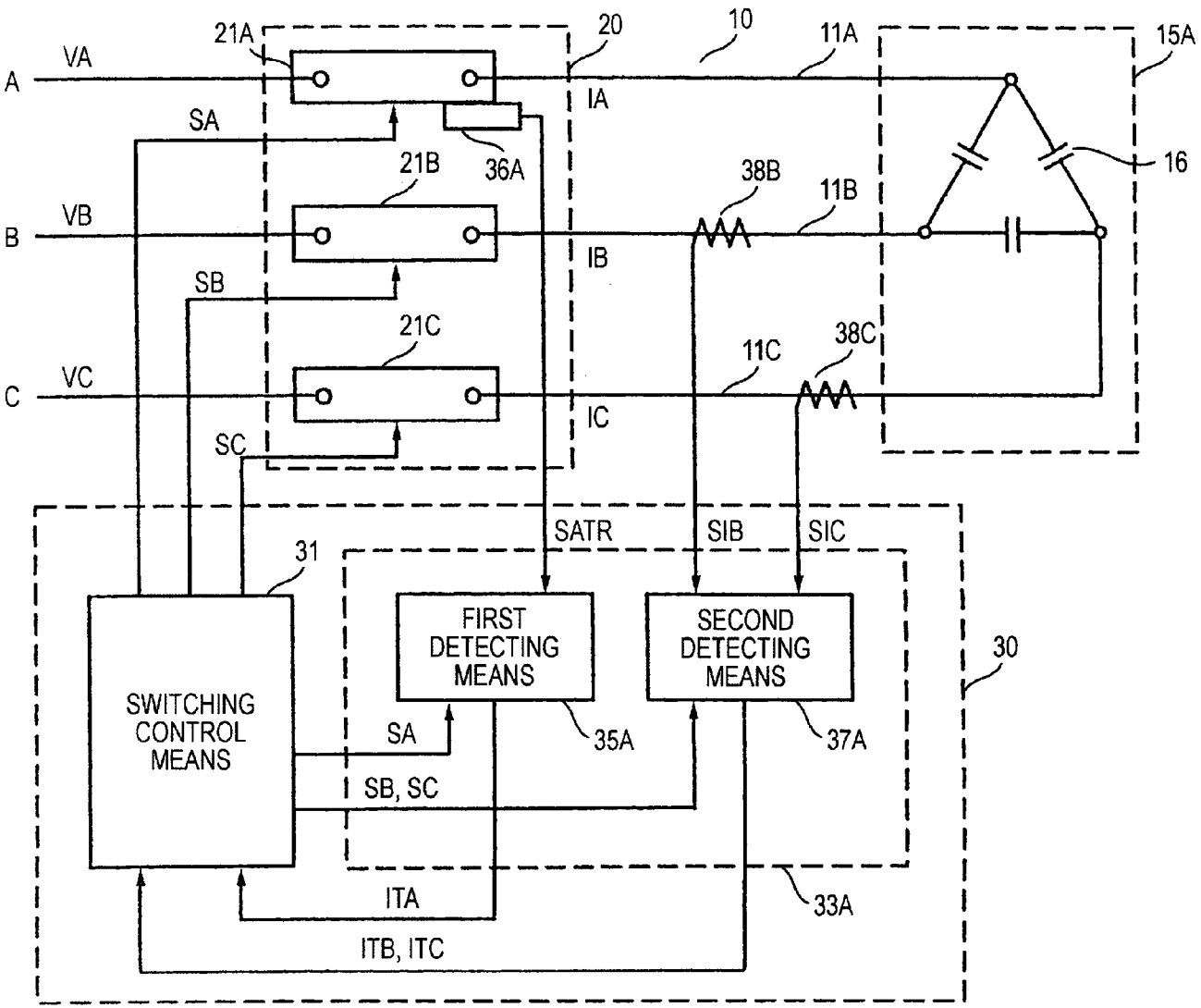
FIG. 1 is a block diagram showing Embodiment 1 of a power switching control apparatus according to this invention.

FIG. 1 is a block diagram showing Embodiment 1 of a power switching control apparatus according to this invention. The power switching control apparatus of Embodiment 1 includes a three-phase AC power circuit 10, a switching apparatus 20 and a control unit 30.

The three-phase AC power circuit 10 is a transmission system or a distribution system for a commercial AC voltage, for example. This three-phase AC power circuit 10 includes A-phase, B-phase and C-phase phase lines 11A, 11B and 11C of A-phase, B-phase and C-phase, and a load 15A connected with the phase lines. In Embodiment 1, the load 15A is a load of the type having a non-grounded neutral point, and is specified by a delta-connected three-phase capacitor bank 16. The phase voltages of the individual phase lines 11A, 11B and 11C on the input sides of individual phase switches 21A, 21B and 21C are designated by VA, VB and VC, and the phase currents on the load sides of the individual phase switches 21A, 21B and 21C are designated by IA, IB and IC.

The switching apparatus 20 switches the individual phase lines 11A, 11B and 11C. This switching apparatus 20 includes the A-phase switch 21A, the B-phase switch 21B and the C-phase switch 21C. The A-phase switch 21A is connected with the phase line 11A, and the B-phase switch 21B and the C-phase switch 21C are connected with the phase lines 11B and 11C, respectively. The individual phase switches 21A, 21B and 21C are exemplified by power breakers, and are arranged either at substations of a power transmission line or at distributors at a transmission line.

The individual phase switches 21A, 21B and 21C are so constituted that they can be controlled independently of one another. The individual phase switches 21A, 21B and 21C are so turned ON at preset phase angles as to suppress the generation of the inrush current or surge voltage severe for the system device of the three-phase AC power circuit 10. The A-phase switch 21A is fed with a making command signal SA from the control unit 30 so that the A-phase switch 21A makes connection of the movable contact with the fixed contact on the basis of that making command signal SA. Similarly, the B-phase switch 21B and the C-phase switch 21C are fed with the making command signals SB and SC, respectively, so that the phase switches 21B and 21C make connection of their individual movable contacts with the fixed contacts on the basis of the making command signals SB and SC.

In the making operations, the individual phase switches 21A, 21B and 21C perform the making operations for making operation times TA, TB and TC. These making operation times TA, TB and TC are operation periods from the making command signals SA, SB and SC to the connections of the movable contacts of the phase switches 21A, 21B and 21C with the fixed contacts. These making operation times TA, TB and TC are dependent on the characteristics of the making mechanisms of the individual phase switches 21A, 21B and 21C but independent of one another, and change with time because the movable contacts and the fixed contacts are consumed by the arc. These making operation times TA, TB and TC also change dependent on the control voltages of the individual phase switches 21A, 21B and 21C on the making mechanisms and on the environmental conditions such as the temperature.

The control unit 30 includes switching control means 31 and making operation time information detecting means 33A. The control unit 30 is constituted by using a microcomputer, for example, and the switching control means 31 and the making operation time information detecting means 33A are also constituted of the operation device, the storage device and so on of the microcomputer. As a matter of fact, the control unit 30 is equipped with not only the making operation time information detecting means 33A but also control voltage detecting means of the switch and environment information detecting means such as the ambient temperature. However, this invention is characterized by the control relating to the making operation times TA, TB and TC, so that the control voltage detecting means and the environment information detecting means are omitted from the description of the invention.

The switching control means 31 generates and feeds the making command signals SA, SB and SC to the individual phase switches 21A, 21B and 21C. The switching control means 31 stores, for the individual phase switches 21A, 21B and 21C, making operation time information ITA, ITB and ITC representing the past making operation times TA, TB and TC, in the storage device of the microcomputer, and generates the making command signals SA, SB and SC with reference to the stored information of the past making operation time information ITA, ITB and ITC so that the individual phase switches 21A, 21B and 21C may be made at the set phases even if their individual making operation times might change. The making command signals SA, SB and SC for the individual phase switches 21A, 21B and 21C are fed to the making operation time information detecting means 33A, too, so as to detect the making operation time information ITA, ITB and ITC indicating the new making operation times TA, TB and TC based thereon.

The making operation time information detecting means 33A includes first detecting means 35A and second detecting means 37A. In Embodiment 1, the first detecting means 35A is coupled to the switching control means 31 and a contact operation sensor 36A arranged in the A-phase switch 21A. This first detecting means 35A receives the making command signal SA for the A-phase switch 21A from the switching control means 31, and receives a contact operation signal SATR indicating the motion of the movable contact of the A-phase switch 21A, from the contact operation sensor 36A. The contact operation sensor 36A is a pulse generator for generating, when the movable contact of the A-phase switch 21A is made to the fixed contact on the basis of the making command signals SA, pulse signals sequentially each time the movable contact turns a unit angle in response to the motion of that movable contact. This pulse signal is fed as the contact operation signal SATR to the first detecting means 35A.

The first detecting means 35A counts, in response to the making command signal SA, the contact operation signal SATR, and counts the lapse time till the counted value reaches the set count which is assumed as the connection between the movable contact and the fixed contact. This lapse time represents the making operation time TA of the A-phase switch 21A. The first detecting means 35A feeds the making operation time information ITA representing the making operation time TA to the switching control means 31. The making operation time information ITA of the A-phase switch 21A is stored at the switching control means 31 in the storage device of the microcomputer, and is used for determining the generation timing of the making command signal SA for the A-phase switch 21A of the next and subsequent times.

In Embodiment 1, the second detecting means 37A is coupled to the switching control means 31 and the B-phase and C-phase phase current sensors 38B and 38C. This second detecting means 37A receives the making command signals SB and SC to the B-phase switch 21B and the C-phase switch 21C, from the switching control means 31, and receives phase current signals SIB and SIC of the B-phase switch 21B and the C-phase switch 21C, from the phase current sensors 38B and 38C. The phase current sensor 38B is coupled to the B-phase line 11B between the B-phase switch 21B and the load 15A, and generates the phase current signal SIB according to a phase current IB of the B-phase switch 21B. Likewise, the phase current sensor 38C is coupled to the C-phase line 11C between the C-phase switch 21C and the load 15A, and generates the phase current signal SIC according to the phase current IC of the C-phase switch 21C.

The second detecting means 37A feeds the making operation time information ITA and ITC of the B-phase switch 21B and the C-phase switch 21C to the switching control means 31. The making operation time information ITB is the sum of the B-phase making lapse time and the B-phase pre-arcing time. The B-phase making lapse time is calculated on the basis of the making command signal SB for the B-phase switch 21B and the phase current signal SIB from the phase current sensor 38B. Specifically, the B-phase making lapse time is calculated as the lapse time from the reception of the making command signal SB to the B-phase conduction starting instant which is determined on the basis of the waveform of the phase current signal SIB. The B-phase pre-arcing time is calculated by dividing the instantaneous value of the B-phase voltage VB at the B-phase conduction starting time, by the rate of change of the insulating characteristics between the movable contact and the fixed contact in the making process of the B-phase switch 21B.

Likewise, the making operation time information ITC is the sum of the C-phase making lapse time and the C-phase pre-arcing time. The C-phase making lapse time is calculated on the basis of the making command signal SC for the C-phase switch 21C and the phase current signal SIC from the phase current sensor 38C. Specifically, the C-phase making lapse time is calculated as the lapse time from the reception of the making command signal SC to the C-phase conduction starting instant which is determined on the basis of the waveform of the phase current signal SIC. The C-phase pre-arcing time is calculated by dividing the instantaneous value of the C-phase voltage VC at the C-phase conduction starting time, by the rate of change of the insulating characteristics between the movable contact and the fixed contact in the making process of the C-phase switch 21C.

The sum of the B-phase making lapse time and the B-phase pre-arcing time, and the sum of the C-phase making lapse time and the C-phase pre-arcing time represent the making operation times TB and TC of the phase switches 21B and 21C, respectively, so that the making operation time information ITB and ITC represent the making operation times TB and TC, respectively. These making operation time information ITB and ITC of those B-phase switch 21B and the C-phase switch 21C are stored at the switching control means 31 in the storage device of the microcomputer and are used for determining the generation timings of the making command signals SB and SC for the B-phase switch 21B and the C-phase switch 21C of the next and subsequent times.

Figure 2:
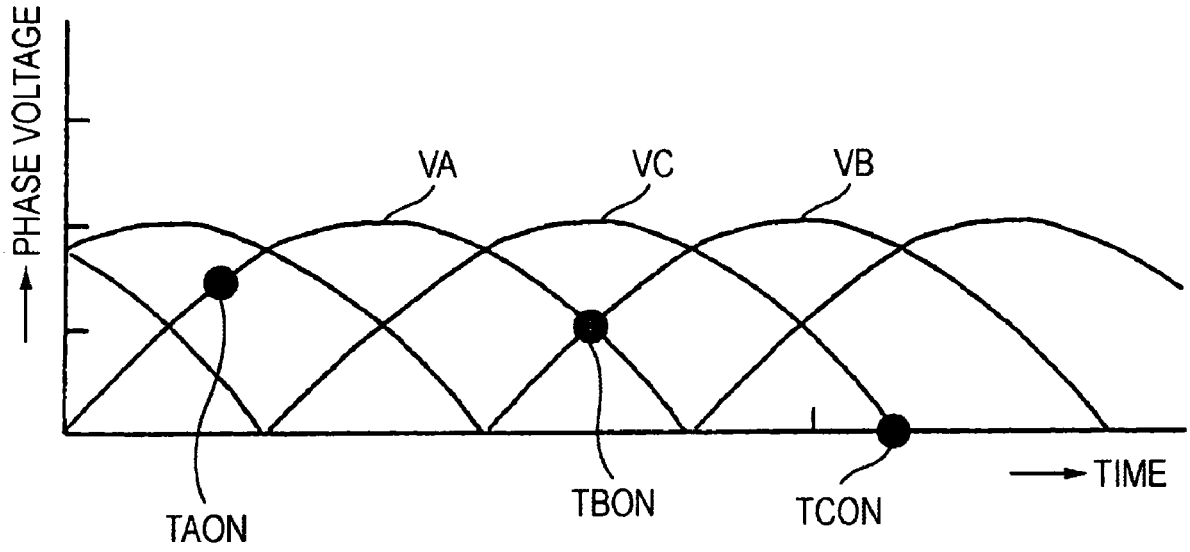
FIG. 2 is an explanatory diagram of making timings of individual phase switches of Embodiment 1.

Now, in Embodiment 1, the making instants TAON, TBON and TCON for the A-phase switch 21A, the B-phase switch 21B and the C-phase switch 21C are set, as shown in FIG. 2, by the switching control means 31, for example. These making instants TAON, TBON and TCON are individually set to suppress the inrush current or surge voltage severe against the system device connected with the three-phase AC power circuit 10. As shown in FIG. 2, more specifically, the making instant TAON for the A-phase switch 21A is set at an arbitrary timing at and before making another phase, e.g., +60 degrees of the reference phase of the A-phase voltage VA in the A-phase line 11A. The making instant TBON for the B-phase switch 21B is set at +150 degrees of the reference phase, for example, and making instant TCON for the C-phase switch 21C is set at +240 degrees of the reference phase, for example. In other words, the making instant TAON precedes the making instant TBON, and the making instant TBON precedes the making instant TCON.

In Embodiment 1, the load 15A is a load of the non-grounded neutral point type. At the making instant TAON of the first A-phase switch 21A, the B-phase switch 21B and the C-phase switch 21C are OFF. In the ON contact of the A-phase switch 21A, therefore, the phase current IA of the A-phase switch 21A does not flow. In Embodiment 1, however, the contact operation sensor 36A is arranged in the A-phase switch 21A. Even without the flow of the phase current IA, the making operation time information ITA representing the making operation time TA of the A-phase switch 21A can be outputted from the first detecting means 35A on the basis of the contact operation signal SATR of the contact operation sensor 36A. At the making instants TBON and TCON for the B-phase switch 21B and the C-phase switch 21C, the phase currents IB and IC of the individual phase switches 21B and 21C flow when the contacts of the switches 21B and 21C are turned ON. On the basis of the phase current signals SIB and SIC from the phase current sensors 38B and 38C, therefore, the making operation time information ITB and ITC representing the making operation times TB and TC of the B-phase switch 21B and the C-phase switch 21C can be outputted from the second detecting means 37A. In Embodiment 1, therefore, the making operation time information ITA, ITB and ITC representing the making operation times TA, TB and TC of all the phase switches 21A, 21B and 21C can be obtained more precisely.

Here in Embodiment 1, even if the phase of the making instant TAON for the A-phase switch 21A changes from the set phase of FIG. 2, the phase current IA does not flow with similar effects, although the A-phase switch 21A is always made, so long as the making instant TAON precedes the making instants TBON and TCON for the B-phase switch 21B and the C-phase switch 21C.

Embodiment 2

Figure 3:
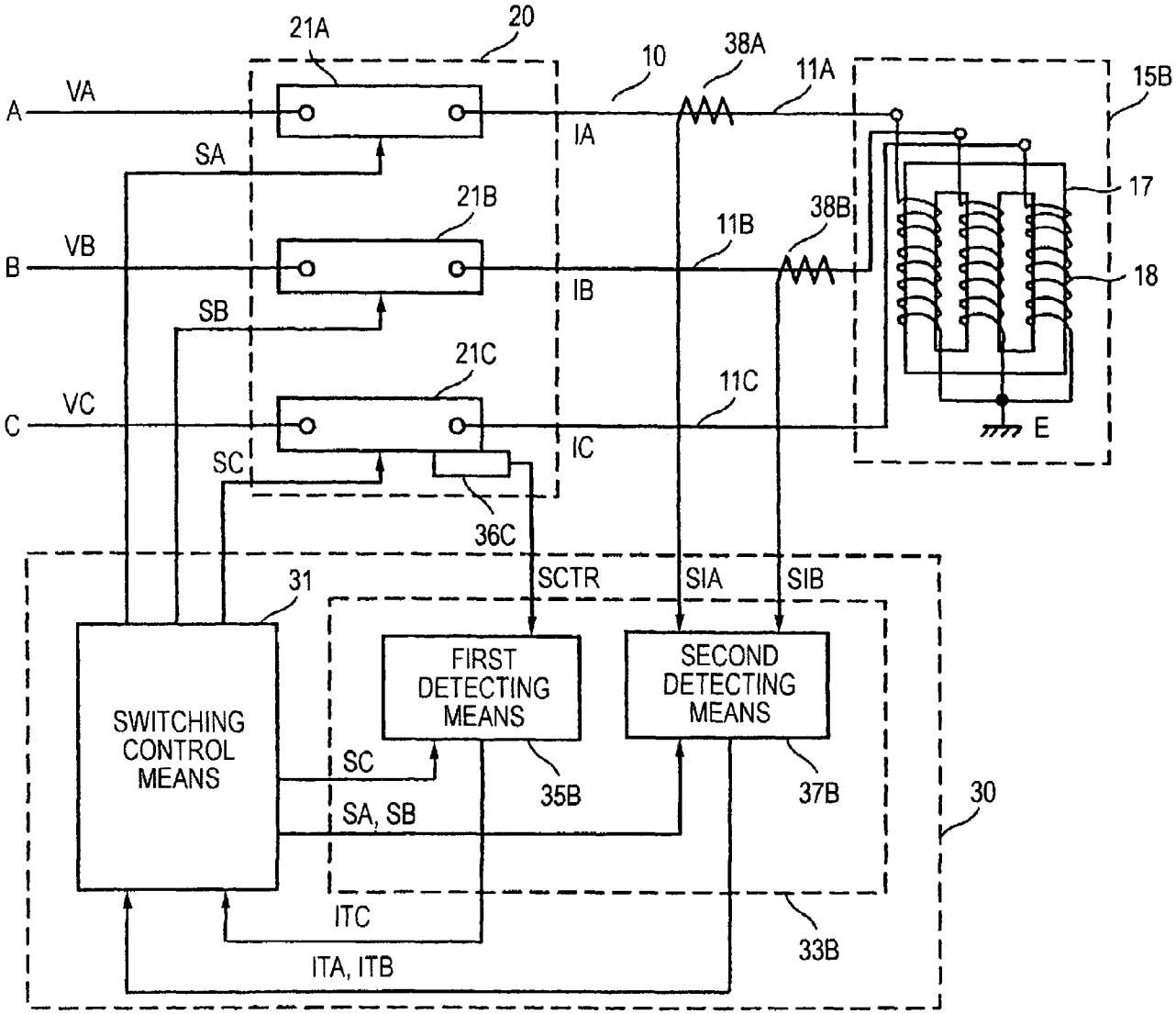
FIG. 3 is a block diagram showing Embodiment 2 of a power switching control apparatus according to this invention.
Figure 4:
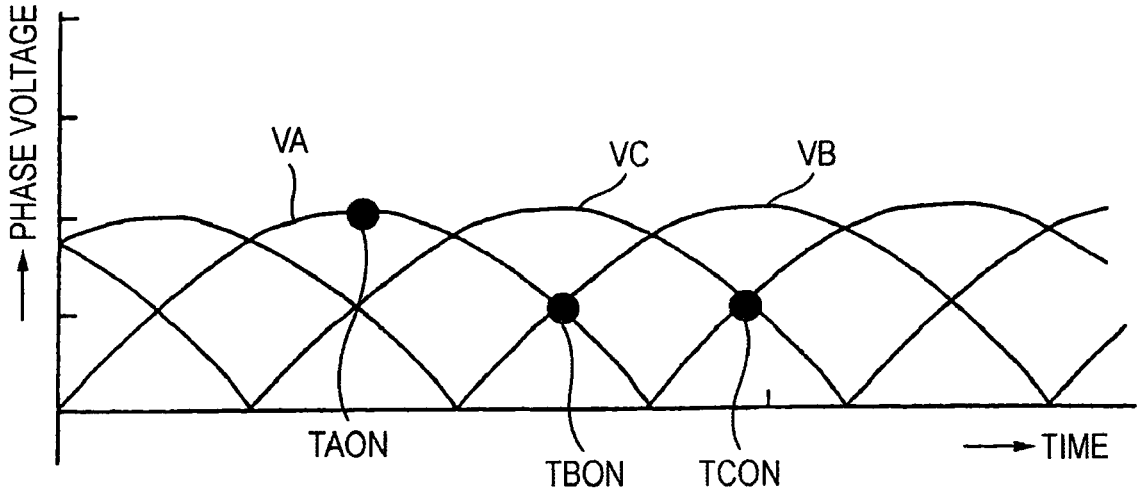
FIG. 4 is an explanatory diagram of making timings of individual phase switches of Embodiment 2.

FIG. 3 is a block diagram showing Embodiment 2 of a power switching control apparatus according to this invention, and FIG. 4 is an explanatory view of making instants TAON, TBON and TCON in Embodiment 2.

In this Embodiment 2, the load 15A of Embodiment 1 is replaced by a load 15B. Moreover, the making instants TAON, TBON and TCON for the individual phase switches 21A, 21B and 21C are so changed, as shown in FIG. 4. Accordingly, in Embodiment 2, the making operation time information detecting means 33A of Embodiment 1 is replaced by making operation time information detecting means 33B. This making operation time information detecting means 33B includes first detecting means 35B and second detecting means 37B. The first detecting means 35B is constituted to receive the making command signal SC from the switching control means 31 and to receive a contact operation signal SCTR from a contact operation sensor 36C arranged in the C-phase switch 21C. Moreover, the second detecting means 37B is constituted to receive the making command signals SA and SB from the switching control means 31, and to receive phase current signals SIA and SIB, respectively, from a phase current sensor 38A coupled to the A-phase line 11A and a phase current sensor 38B coupled to the B-phase line 11B. The remaining constitutions are identical to those of Embodiment 1.

In this Embodiment 2, the load 15B is the load of the grounded neutral point type with the phase-shared core. This load 15B is formed into a cored reactor or transformer connected in a star shape. The load 15B has a core 17 shared among the individual phases, and this core 17 is wounded by a reactor 18 connected with the individual phase lines 11A, 11B and 11C. The reactor 18 is connected in a star shape, and has its neutral point connected with the earth point E.

In Embodiment 2, moreover, the making instants TAON, TBON and TCON for the individual phase switches 21A, 21B and 21C are so set by the switching control means 31 as are shown in FIG. 4. The making instant TAON of the A-phase switch 21A is set at +90 degrees, for example, with respect to the reference phase of the phase voltage VA; the making instant TBON of the B-phase switch 21B is set at +150 degrees, for example, with respect to the reference phase; and the making instant TCON of the C-phase switch 21C is set at +210 degrees, for example, with respect to the reference phase.

In Embodiment 2, the first detecting means 35B receives the contact operation signal SCTR indicating the motion of the movable contact of the C-phase switch 21C from the contact operation sensor 36C. Specifically, the contact operation sensor 36C is a pulse generator for generating, when the movable contact of the C-phase switch 21C is made toward the fixed contact on the basis of the making command signal SC, pulse signals sequentially in response to the motion of that movable contact each time the movable contact turns a unit angle. This pulse signal is fed as the contact operation signal SCTR to the first detecting means 35B.

The first detecting means 35B counts the contact operation signal SCTR when it receives the making command signal SC, and counts the lapse time, till the counted value reaches the set count, at which the movable contact and the fixed contact are made. This lapse time indicates the making operation time TC of the C-phase switch 21C. The first detecting means 35B feeds the making operation time information ITC indicating that making operation time TC, to the switching control means 31. The making operation time information ITC of the C-phase switch 21C is stored at the switching control means 31 in the storage device of the microcomputer, and is used for determining the generation timing of the making command signal SC for the C-phase switch 21C of the next and subsequent times.

In Embodiment 2, the second detecting means 37B receives the making command signals SA and SB to the A-phase switch 21A and the B-phase switch 21B, from the switching control means 31, and receives phase current signals SIA and SIB of the A-phase switch 21A and the B-phase switch 21B, from the phase current sensors 38A and 38B. The phase current sensor 38A is coupled to the A-phase line 11A between the A-phase switch 21A and a load 13, and generates the phase current SIA according to a phase current IA of the A-phase switch 21A. The phase current sensor 38B is coupled, as in Embodiment 1, to the B-phase line 11B between the B-phase switch 21B and a load 13A, and generates the phase current signal SIB according to the phase current IB of the B-phase switch 21B.

The second detecting means 37B feeds the making operation time information ITA and ITB of the A-phase switch 21A and the B-phase switch 21B to the switching control means 31. The making operation time information ITA is the sum of the A-phase making lapse time and the A-phase pre-arcing time. The A-phase making lapse time is calculated on the basis of the making command signal SA for the A-phase switch 21A and the phase current signal SIA from the phase current sensor 38A. Specifically, the A-phase making lapse time is calculated as the lapse time from the reception of the making command signal SA to the A-phase conduction starting instant which is determined on the basis of the waveform of the phase current signal SIA. The A-phase pre-arcing time is calculated by dividing the instantaneous value of the A-phase voltage VA at the A-phase conduction starting time, by the rate of change of the insulating characteristics between the movable contact and the fixed contact in the making process of the A-phase switch 21A.

Like Embodiment 1, the making operation time information ITB is the sum of the B-phase making lapse time and the B-phase pre-arcing time. The B-phase making lapse time is calculated on the basis of the making command signal SB for the B-phase switch 21B and the phase-current signal SIB from the phase current sensor 38B. Specifically, the B-phase making lapse time is calculated as the lapse time from the reception of the making command signal SB to the B-phase conduction starting instant which is determined on the basis of the waveform of the phase current signal SIB. The B-phase pre-arcing time is calculated by dividing the instantaneous value of the B-phase voltage VB at the B-phase conduction starting time, by the rate of change of the insulating characteristics between the movable contact and the fixed contact in the making process of the B-phase switch 21B.

The sum of the A-phase making lapse time and the A-phase pre-arcing time, and the sum of the B-phase making lapse time and the B-phase pre-arcing time represent the making operation times TA and TB of the phase switches 21A and 21B, respectively, so that the making operation time information ITA and ITB represent the making operation times TA and TB, respectively. These making operation time information ITA and ITB of those A-phase switch 21A and the B-phase switch 21B are stored at the switching control means 31 in the storage device of the microcomputer and are used for determining the generation timings of the making command signals SA and SB for the A-phase switch 21A and the B-phase switch 21B of the next and subsequent times.

In Embodiment 2, the load 15B is a load of the grounded neutral point type with the common core. At the making instant TAON of the first A-phase switch 21A and at the making instant TBON of the next B-phase switch 21B, the phase currents IA and IB flow when those contacts are ON. On the basis of the phase current signals SIA and SIB of the phase current sensors 38A and 38B, therefore, the making operation time information ITA and ITB indicating the making operation times TA and TB of the A-phase switch 21A and the B-phase switch 21B can be outputted from the second detecting means 37B.

In this Embodiment 2, at the making instant TCON for the C-phase switch 21C, the A-phase switch 21A and the B-phase switch 21B are made beforehand. Therefore, the voltage to be induced in the reactor 18 connected with the C-phase line 11C is equal to the C-phase voltage VC so that the voltage between those contacts is made in the substantial "0" voltage on the C-phase switch 21C. In the C-phase switch 21C, therefore, the pre-arc does not occur before the contact is turned ON. From this phase current IC, the making operation time information TC cannot be determined as in the other A-phase and B-phase. In this Embodiment 2, however, the contact operation sensor 36C is arranged in the C-phase switch 21C. Even if the pre-arc does not occur at the making instant of the C-phase switch 21C, the making operation time information ITC indicating the making operation time TC of the C-phase switch 21C can be outputted from the first detecting means 35B on the basis of the contact operation signal SCTR of the contact operation sensor 36C. As a result, it is possible to make more precise the making operation time information ITA, ITB and ITC indicating the making operation times TA, TB and TC of all the phase switches 21A, 21B and 21C.

Here in Embodiment 2, so long as the phase of the making instant TCON with respect to the C-phase switch 21C is after the making instants TAON and TBON for the A-phase switch 21A and the B-phase switch 21B even if it changes from the set phase of FIG. 4, the C-phase switch 21C is made with similar effects in the substantially "0" voltage between contacts. Even at the making instants TAON, TBON and TCON shown in FIG. 2, similar effects can be obtained because the making instant TCON for the C-phase switch 21C occurs after the making instants TAON and TBON for the A-phase switch 21A and the B-phase switch 21B.

Embodiment 3

Figure 5:
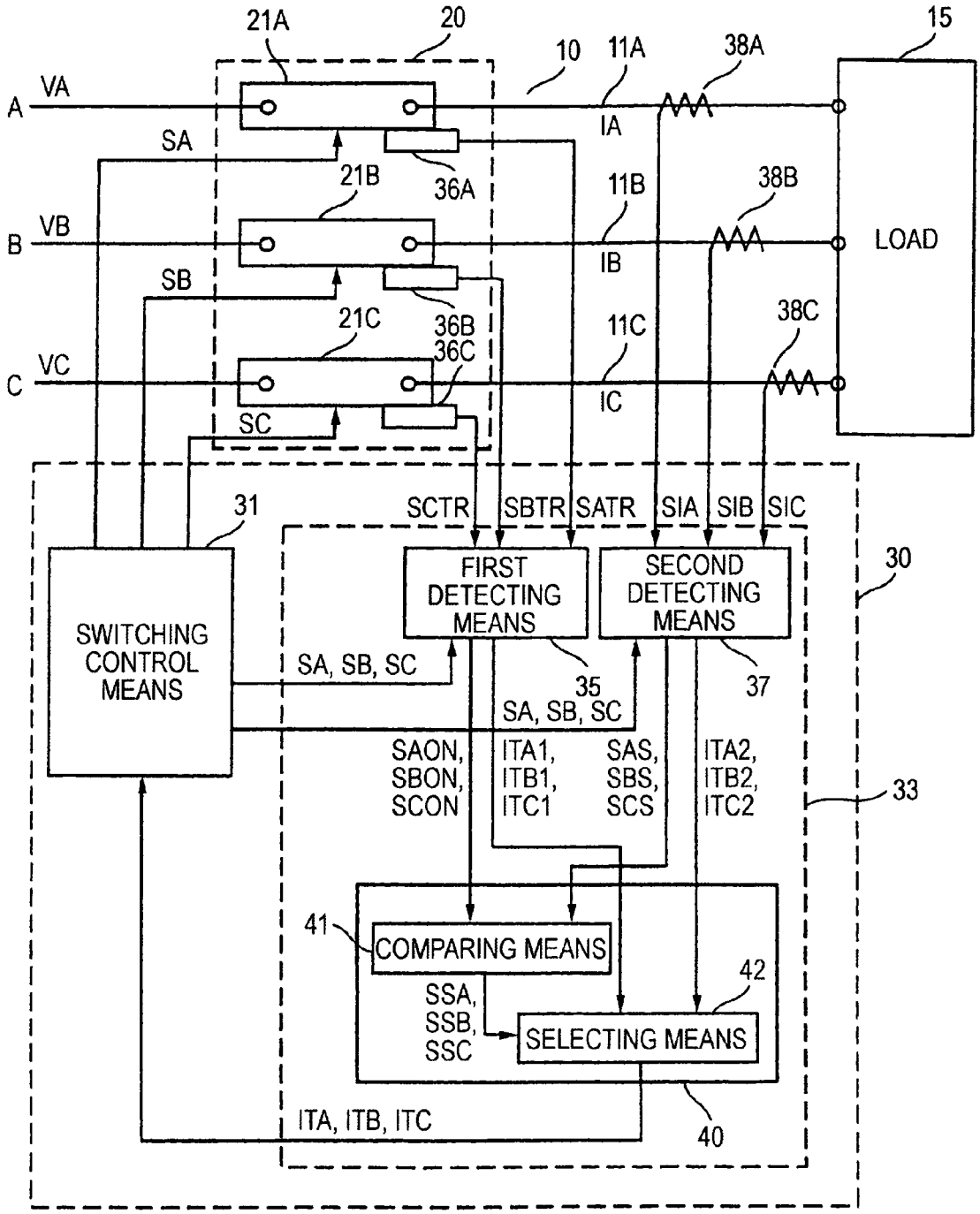
FIG. 5 is a block diagram showing Embodiment 3 of a power switching control apparatus according to this invention.

FIG. 5 is a block diagram showing Embodiment 3 of a power switching control apparatus according to this invention. In this power switching control apparatus of Embodiment 3, the load 15A in Embodiment 1 is replaced by an arbitrary three-phase load 15, the making instants TAON, TBON and TCON for the individual phase switches 21A, 21B and 21C are arbitrarily set. Accordingly, in Embodiment 3, the making operation time information detecting means 33A of Embodiment 1 is replaced by making operation time information detecting means 33. This making operation time information detecting means 33 includes first detecting means 35, second detecting means 37 and comparing-selecting means 40. The first detecting means 35 is constituted to receive the making command signals SA, SB and SC from the switching control means 31 and to receive the contact operation signals SATR, SBTR and SCTR, respectively, from contact operation sensors 36A, 36B and 36C arranged in the phase switches 21A, 21B and 21C, respectively. On the other hand, the second detecting means 37 is constituted to receive the making command signals SA, SB and SC from the switching control means 31 and to receive the phase current signals SIA, SIB and SIC of the phase switches 21A, 21B and 21C from the phase current sensors 38A, 38B and 38C coupled to the individual phase lines 11A, 11B and 11C, respectively. The comparing-selecting means 40 includes comparing means 41 and selecting means 42. The remaining constitutions are similar to those of Embodiment 1.

The load 15 of this Embodiment 3 is an arbitrary three-phase load, which can be used as any of the load 15A of the non-grounded neutral point type, as shown in FIG. 1, the common core load 15B of the grounded neutral point type, as shown in FIG. 3, or another three-phase load. Moreover, the making instants TAON, TBON and TCON for the individual phase switches 21A, 21B and 21C are also arbitrarily set to those of FIG. 2 or FIG. 4 or other timings.

The contact operation sensors 36A, 36B and 36C arranged at the individual phase switches 21A, 21B and 21C are pulse generators for generating pulse signals sequentially each time the movable contacts of the corresponding phase switches 21A, 21B and 21C turn by unit angles in response to the motion of the movable contacts when the movable contacts are made toward the fixed contacts on the basis of the making command signals SA, SB and SC. These pulse signals are fed as the contact operation signals SATR, SBTR and SCTR to the first detecting means 35.

In response to the individual making command signals SA, SB and SC, the first detecting means 35 counts the individual contact operation signals SATR, SBTR and SCTR, and generates the contact ON signals SAON, SBON and SCON when the counted value reaches the set value, at which the movable contacts and the fixed contacts of the corresponding phase switches 21A, 21B and 21C are made. In this Embodiment 3, the contact ON signals SAON, SBON and SCON are outputted from the first detecting means 35 to the comparing means 41 of the comparing-selecting means 40. In response to the individual making command signals SA, SB and SC, moreover, the first detecting means 35 counts the individual contact operation signals SATR, SBTR and SCTR, individually, and counts the lapse times till the reach of the set counts, at which it is imagined that the movable contacts and the fixed contacts of the corresponding phase switches 21A, 21B and 21C are made. These individual lapse times are the first information representing the making operation times TA, TB and TC of the individual phase switches 21A, 21B and 21C, and the first detecting means 35 outputs the individual lapse times as first making operation time information ITA1, ITB1 and ITC1 from the first detecting means 35 to the selecting means 42.

The individual phase current sensors 38A, 38B and 38C are coupled to the individual phase lines 11A, 11B and 11C between the phase switches 21A, 21B and 21C and the load 15, and generate the phase current signals SIA, SIB and SIC according to the phase currents IA, IB and IC flowing through the phase switches 21A, 21B and 21C, respectively. At the making instants of the individual phase switches 21A, 21B and 21C, the pre-arc may occur or not, depending upon the kind of the load 15 and the settings of the making instants TAON, TBON and TCON.

The phase current signals SIA, SIB and SIC are individually fed to the second detecting means 37. In Embodiment 3, at the timings of the phase current signals SIA, SIB and SIC to flow, current flow starting signals SAS, SBS and SCS indicating the current flow starts are generated by the second detecting means 37 and are fed to the comparing means 41. In case the pre-arcs occur, these current flow starting signals SAS, SBS and SCS indicate the starting points of the pre-arcs, at which the flows start before the contacts of the individual phase switches are turned ON. In the absence of the pre-arcs, the current flow starting signals SAS, SBS and SCS indicate the flow starts of the phase currents which start to flow after the contacts of the corresponding phase switches were turned ON.

On the basis of the individual making command signals SA, SB and SC and the individual phase current signals SIA, SIB and SIC, moreover, the second detecting means 37 generates second making operation time information ITA2, ITB2 and ITC2 of the individual phase switches 21A, 21B and 21C, and feeds the second making operation time information ITA2, ITB2 and ITC2 to the selecting means 42 of the comparing-selecting means 40. The second making operation time information ITA2, ITB2 and ITC2 are effective in case the corresponding phase switches 21A, 21B and 21C are followed by the pre-arcs. In case the making of the corresponding phase switches 21A, 21B and 21C is not followed by the pre-arcs, the second making operation time information ITA2, ITB2 and ITC2 are the signals considering the pre-arcs which do not really exist, so that they are ineffective.

The comparing means 41 of the comparing-selecting means 40 receives contact ON signals SAON, SBON and SCON from the first detecting means 35 and the current flow starting signals SAS, SBS and SCS from the second detecting means 37. This comparing means 41 compares the contact ON signals SAON, SBON and SCON and the current flow starting signals SAS, SBS and SCS to decide the effectiveness of the second making operation time information ITA2, ITB2 and ITC2, and outputs select signals SSA, SSB and SSC representing the effectiveness to the selecting means 42. This selecting means 42 is fed with the first making operation time information ITA1, ITB1 and ITC1 from the first detecting means 35, and with the second making operation time information ITA2, ITB2 and ITC2 from the second detecting means 37. On the basis of the select signals SSA, SSB and SSC, the selecting means 42 selects either the first making operation time information ITA1, ITB1 and ITC1 and the second making operation time information ITA2, ITB2 and ITC2, and outputs the making operation time signals ITA, ITB and ITC to the switching control means 31.

The making operation time information ITA is selected, on the basis of the select signal SSA, from either of the first and second making operation time information ITA1 and ITA2. When the comparing means 41 decides that the second making operation time information ITA2 is effective, the select signal SSA instructs the selecting means 42 to select the second making operation time signal ITA2, so that the select means 42 outputs the second making operation time information ITA2 as the making operation time information ITA. When the comparing means 41 decides that the second making operation time information ITA2 is ineffective, the selecting means 42 outputs the first making operation time information ITA1 as the making operation time information ITA. Likewise, the making operation time information ITB is selected, on the basis of the select signal SSB, from either of the first and second making operation time information ITB1 and ITB2. When the comparing means 41 decides that the second making operation time information ITB2 is effective, the select signal SSB instructs the selecting means 42 to select the second making operation time signal ITB2, so that the select means 42 outputs the second making operation time information ITB2 as the making operation time information ITB. When the comparing means 41 decides that the second making operation time information ITB2 is ineffective, the selecting means 42 outputs the first making operation time information ITB1 as the making operation time information ITB. Likewise, the making operation time information ITC is selected, on the basis of the select signal SSC, from either of the first and second making operation time information ITC1 and ITC2. When the comparing means 41 decides that the second making operation time information ITC2 is effective, the select signal SSC instructs the selecting means 42 to select the second making operation time signal ITC2, so that the select means 42 outputs the second making operation time information ITC2 as the making operation time information ITC. When the comparing means 41 decides that the second making operation time information ITC2 is ineffective, the selecting means 42 outputs the first making operation time information ITC1 as the making operation time information ITC.

The effectiveness of the second making operation time information ITA2, ITB2 and ITC2 by the comparing means 41 is decided on the individual contact ON signals SAON, SBON and SCON. By using the generation timings of the individual contact ON signals SAON, SBON and SCON as the reference timings, it is decided whether or not the current flow starting signals SAS, SBS and SCS are present for a constant period at and before the reference timing containing the reference timing. If the current flow starting signals are present for the aforementioned individual predetermined periods, it is decided that the current flow starting signals indicate the starting points of the pre-arcs, and that the corresponding second making operation time information is effective. Otherwise, it is decided that the current flow starting signals are not the starting points of the pre-arcs, and that the corresponding second making operation time information is ineffective.

For example, the load 15 is the load 15A of the non-grounded neutral point type, as shown in FIG. 1, the A-phase switch 21A of the individual phase switches 21A, 21B and 21C may be made earlier than the remaining B-phase switch 21B and the C-phase switch 21C. In this case, the phase current IA does not flow in the A-phase switch 21A made first. The current flow starting signal SAS flows after the B-phase switch 21B is made after the contact ON signal SAON so that the second making operation time information ITA2 corresponding to the phase current signal SIA is made ineffective. When the B-phase switch 21B and the C-phase switch 21C are made, on the other hand, the phase currents IB and IC flow from the starting points of the pre-arcs. By using the generating timings of the contact ON signals SBON and SCON as the reference timings, therefore, the current flow starting signals SBS and SCS exist for the constant time period at and before the reference timing including that reference timings. It is, therefore, decided that the second making operation time information ITB2 and ITC2 corresponding to those phase current signals SIB and SIC are effective.

Moreover, the load 15 is the load 15B with the common core of the grounded neutral point type, as shown in FIG. 3, and the C-phase switch 21C of the individual phase switches 21A, 21B and 21C is finally made at the making instant TCON after the A-phase switch 21A and the B-phase switch 21B. In this case, the C-phase switch 21C is made with the voltage between the contacts being substantially 0 voltage, so that its phase current IC flows after the contact of the C-phase switch 21C is turned ON. It is, therefore, decided that the second making operation time information ITC2 corresponding to the phase current signal IC is ineffective. When the A-phase switch 21A and the B-phase switch 21B are made, on the other hand, the phase currents IA and IB flow from the starting points of the pre-arcs. By using the generating timings of the contact ON signals SAON and SBON as the reference timings, therefore, the current flow starting signals SAS and SBS exist for the constant time period at and before the reference timing including that reference timings. It is, therefore, decided that the second making operation time information ITA2 and ITB2 corresponding to those phase current signals SIA and SIB are effective.

Thus according to Embodiment 3, irrespective of the kind of the load 15 and the making instants TAON, TBON and TCON of the individual phase switches 21A, 21B and 21C, either of the first making operation time information ITA1, ITB1 and ITC1 and the second making operation time information ITA2, ITB2 and ITC2 can always be selected to detect all the making operation time information ITA, ITB and ITC more precisely.

The power switching control apparatus according to this invention is utilized as the switching control apparatus for the three-phase AC power circuit.

Various modifications and alterations of this invention will be apparent to those skilled in the art without departing from the scope and spirit of this invention, and it should be understood that this is not limited to the illustrative embodiments set forth herein.

What is claimed is:

1. A power switching control apparatus having an A-phase switch, a B-phase switch and a C-phase switch connected with the A-phase, B-phase and C-phase of a three-phase AC power circuit, respectively, for controlling the individual phase switches independently of one another, comprising:

making operation time information detecting means for outputting making operation time information ITA, ITB and ITC representing the individual making operation times of said A-phase switch, said B-phase switch and said C-phase switch, respectively; and switching control means for controlling the making instants of said A-phase switch, said B-phase switch and said C-phase switch on the basis of said making operation time information ITA, ITB and ITC, wherein said making operation time information detecting means outputs the making operation time information of at least one of said individual phase switches on the basis of the motion of the movable contact of said phase switch, and outputs the making operation time information of at least another one of said individual phase switches on the basis of the phase current of said phase switch.

2. A power switching control apparatus according to claim 1, wherein said switching control means controls to make said A-phase switch prior to said B-phase switch and said C-phase switch, and wherein said making operation time information detecting means outputs the making operation time information ITA of said A-phase switch on the basis of the motion of the movable contact of said A-phase switch, and outputs the making operation time information ITB and ITC of said B-phase switch and said C-phase switch on the basis of said B-phase and C-phase currents.

3. A power switching control apparatus according to claim 2, wherein a contact operation sensor for detecting the motion of the movable contact of said A-phase switch, and two phase current sensors for detecting said B-phase and C-phase phase currents are connected with said making operation time information detecting means.

4. A power switching control apparatus according to claim 1, wherein said switching control means controls to make said A-phase switch and said B-phase switch at the instants, in which the voltage is applied between the individual contacts, and to make said C-phase switch at the instant, in which the voltage is not substantially applied between the individual contacts, and wherein said making operation time information detecting means outputs the making operation time information ITA and ITB of said A-phase switch and said B-phase switch on the basis of said A-phase and B-phase phase currents, and outputs the making operation time information ITC of said C-phase switch on the basis of the motion of the movable contact of said C-phase switch.

5. A power switching control apparatus according to claim 4, wherein two phase current sensors for detecting said A-phase and B-phase phase currents and a contact operation sensor for detecting the motion of the movable contact of said C-phase switch are connected with said making operation time information detecting means.

6. A power switching control apparatus having an A-phase switch, a B-phase switch and a C-phase switch connected with the A-phase, B-phase and C-phase of a three-phase AC power circuit, respectively, for controlling the individual phase switches independently of one another, comprising:

making operation time information detecting means for outputting making operation time information ITA, ITB and ITC representing the individual making operation times of said A-phase switch, said B-phase switch and said C-phase switch, respectively; and switching control means for controlling the making instants of said A-phase switch, said B-phase switch and said C-phase switch on the basis of said making operation time information ITA, ITB and ITC, wherein three contact operation sensors for detecting the motions of the individual movable contacts of said A-phase switch, said B-phase switch and said C-phase switch, and three phase current sensors for detecting the individual phase currents of said A-phase, said B-phase and said C-phase are connected with said making operation time information detecting means, and wherein said making operation time information detecting means outputs the making operation time information ITA, ITB and ITC of said A-phase switch, said B-phase switch and said C-phase switch individually on the basis of one of the detected output of said contact operation sensor and the detected output of said phase current sensor.

7. A power switching control apparatus according to claim 6, wherein said making operation time information detecting means outputs, with reference to the timings at which said contact operation sensor detects that the movable contact of each of said A-phase switch, said B-phase switch and said C-phase switch has arrived at a predetermined position, said making operation time information ITA, ITB and ITC individually on the basis of the detected output of said phase current sensor, in case the change in the detected output of said corresponding phase current sensor is within a predetermined time period, and on the basis of the detected output of said contact operation sensor, in case the change in the detected output of said phase current sensor is not within said predetermined time period.

* * * * *